US008950099B2

(12) United States Patent
Rogers et al.

(10) Patent No.: US 8,950,099 B2
(45) Date of Patent: Feb. 10, 2015

(54) COLLAPSIBLE STOCK ASSEMBLY

(75) Inventors: William H. Rogers, St. Augustine, FL (US); Matthew E. McKendrick, Jacksonville, FL (US)

(73) Assignee: Rogers Holster Co., LLC, Jacksonville, FL (US)

( * ) Notice: Subject to any disclaimer, the term of this patent is extended or adjusted under 35 U.S.C. 154(b) by 134 days.

(21) Appl. No.: 13/825,942

(22) PCT Filed: Aug. 26, 2011

(86) PCT No.: PCT/US2011/049396

§ 371 (c)(1), (2), (4) Date: Mar. 25, 2013

(87) PCT Pub. No.: WO2012/050670

PCT Pub. Date: Apr. 19, 2012

(65) Prior Publication Data

US 2013/0180148 A1 Jul. 18, 2013

Related U.S. Application Data

(63) Continuation-in-part of application No. 29/375,873, filed on Sep. 29, 2010, now Pat. No. Des. 668,311.

(51) Int. Cl.
*F41C 23/14* (2006.01)
*F41C 23/04* (2006.01)

(52) U.S. Cl.
CPC ..... *F41C 23/04* (2013.01)
USPC ..... 42/73; 42/71.01

(58) Field of Classification Search
CPC ..... F41C 23/04; F41C 23/14
USPC ..... 42/73, 71.01
See application file for complete search history.

(56) References Cited

U.S. PATENT DOCUMENTS

| | | | | |
|---|---|---|---|---|
| 7,823,313 | B2 * | 11/2010 | Faifer | 42/74 |
| 8,555,541 | B2 * | 10/2013 | Ingram | 42/71.01 |
| 8,782,941 | B2 * | 7/2014 | Zusman | 42/73 |
| 2010/0242333 | A1 * | 9/2010 | Kincel | 42/73 |
| 2013/0097911 | A1 * | 4/2013 | Larue | 42/73 |

* cited by examiner

*Primary Examiner* — J. Woodrow Eldred
(74) *Attorney, Agent, or Firm* — Arthur G. Yeager

(57) ABSTRACT

A collapsible stock assembly for a firearm includes a stock body defining a buffer tube passage for slidably accommodating a firearm buffer tube therein. An adjustment slit communicates with the buffer tube passage along a forward portion thereof. A first adjustment mechanism canied by the stock body includes a buffer tube engagement element that can extend into the buffer tube passage and is selectively positionable by a first operating lever. A second operating mechanism includes a second operating lever that is operable to selectively compress the adjustment slit. Disengaging the first adjustment mechanism automatically disengages the second adjustment mechanism. Excessive force on the stock in several embodiments automatically disengages both adjustment mechanisms and minimizes damage to stock assembly and/or buffer tube.

20 Claims, 9 Drawing Sheets

COLLAPSIBLE STOCK ASSEMBLY

CROSS-REFERENCE TO RELATED APPLICATION

This application is a continuation-in-part of U.S. patent application Ser. No. 29/375,873, filed on Sep. 29, 2010, now U.S. Pat. No. D668,311 the contents of which are herein incorporated by reference in their entirety.

FIELD OF THE INVENTION

The present invention relates to collapsible stock assemblies for firearms, and more particularly, to collapsible rifle stock assemblies.

BACKGROUND OF THE INVENTION

Various firearms, and particularly assault rifles, have been designed to include a collapsible stock. In general, such firearms include a buffer tube on which the collapsible stock is axially slidable. Some mechanism is typically included on the stock to fix its axial position on the buffer tube to allow the user to quickly adjust the effective length of the stock.

One example of such a firearm is the M-4 rifle. The M-4 is a widely used and popular rifle, and users value the ability to rapidly adjust the effective length of the stock. However, problems experienced with the collapsible stock of the M-4 rifle can be illustrative of shortcoming of current designs.

For example, while the axial position of the collapsible stock is maintained relatively securely, clearances between the stock and buffer tube often result in a loose, wobbly feel—particularly when the collapsible stock is in the fully extended position and a relatively small portion of the buffer tube is engaged within the collapsible stock. This loose, wobbly feel can be distracting to the user and adversely impact marksmanship.

This type of fit problem can be exacerbated when, as is the case with the M-4 rifle, models of a given rifle are available with varying buffer tube diameters. A collapsible stock dimensioned to accommodate larger buffer tube diameters will tend to be excessively wobbly on smaller buffer tube diameters. On the other hand, a collapsible stock dimensioned to more closely accommodate smaller buffer tubes may not fit on larger buffer tubes, at all.

Additionally, with repeated cycling of the collapsible stock assembly, wear of the stock assembly (typically plastic) against the buffer tube (typically metal) will increase clearances. Accordingly, the fit problems can become worse over time.

SUMMARY OF THE INVENTION

In view of the foregoing, it is an object of the present invention to provide an improved stock assembly. According to an embodiment of the present invention, a collapsible stock assembly for a firearm includes a stock body defining a buffer tube passage for slidably accommodating a buffer tube of the firearm therein. An adjustment slit communicates with the buffer tube passage along a forward portion thereof. A first adjustment mechanism carried by the stock body includes a buffer tube engagement element that can extend into the buffer tube passage and is selectively positionable by a first operating lever. A second operating mechanism includes a second operating lever that is operable to selectively compress the adjustment slit.

According to an aspect of the present invention, disengaging the first adjustment mechanism can operate to automatically disengage the second adjustment mechanism.

These and other objects, aspects and advantages of the present invention will be better appreciated in view of the drawings and following detailed description of preferred embodiments.

DETAILED DESCRIPTION OF PREFERRED EMBODIMENTS

Figure 1:
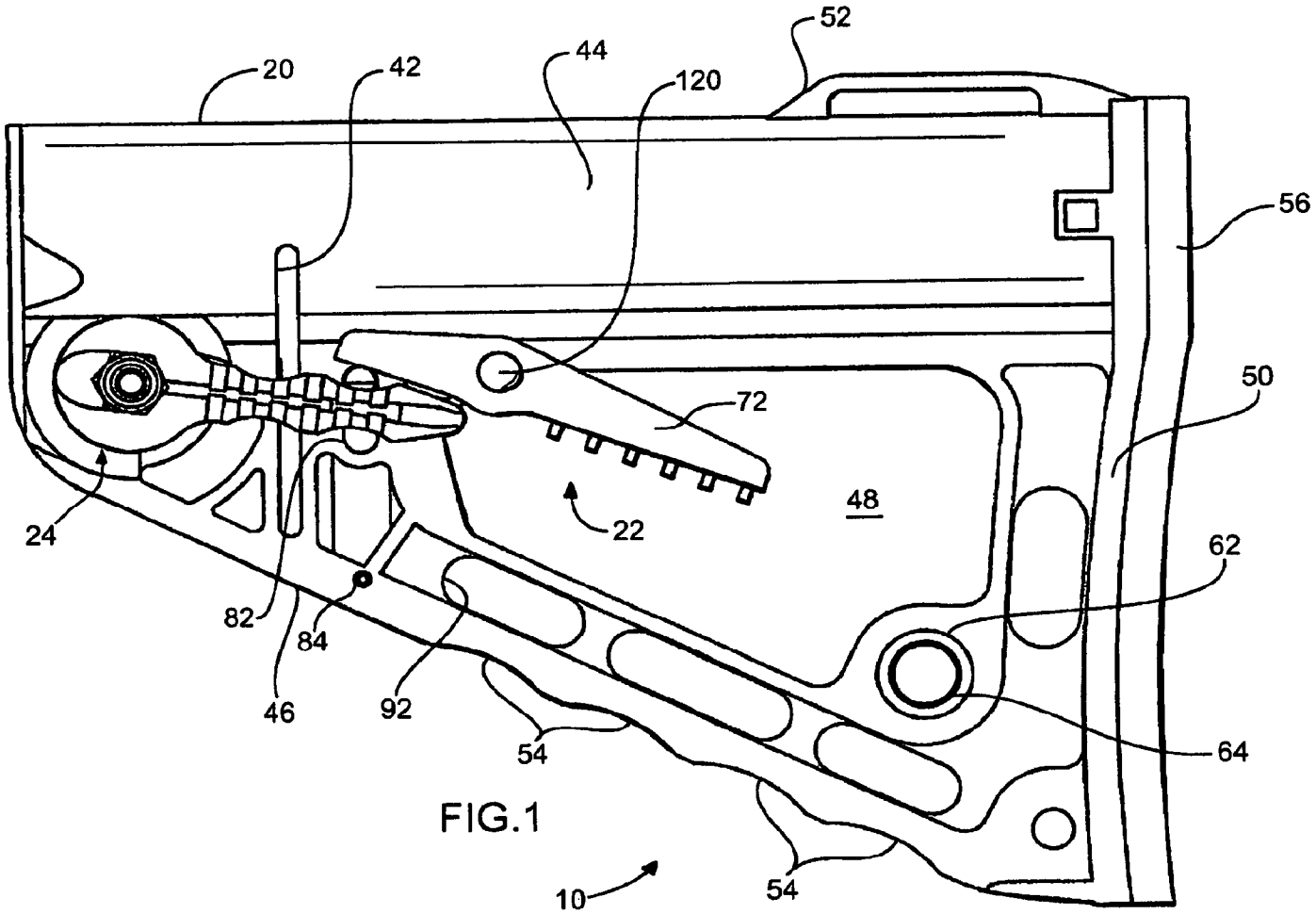
FIG. 1 is a side view of a collapsible stock assembly for a firearm, including first and second adjustment mechanisms and sizing components, according to an embodiment of the present invention.
Figure 2:
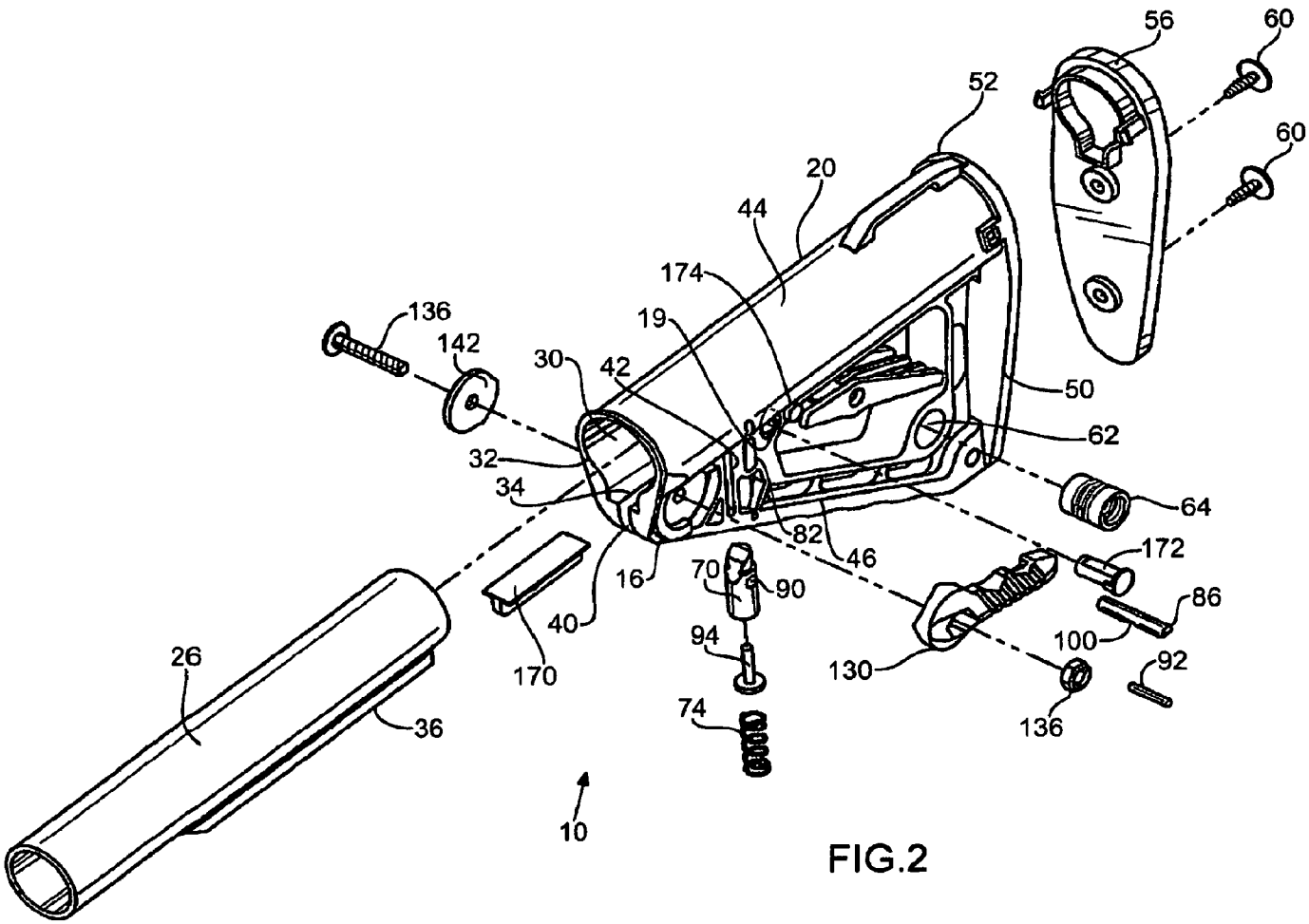
FIG. 2 is an exploded perspective view of the stock assembly of FIG. 1, also including a firearm buffer tube.

According to an embodiment of the present invention, with reference to FIGS. 1 and 2, a collapsible stock 10 for a firearm includes a stock body 20, a first adjustment mechanism 22 and a second adjustment mechanism 24. The first and second adjustment mechanisms 22, 24 cooperate to releasably secure the stock body 20 at a plurality of discrete locations to and along a buffer tube 26 of the firearm.

The stock body 20 defines a buffer tube passage 30 therein, a forward end of the passage 30 terminating at a buffer tube insertion opening 32. The buffer tube insertion opening 32 permits a rear end of buffer tube 26 to be inserted therethrough into the passage 30 along an axis thereof. The buffer tube passage 30 is dimensioned to slidably accommodate at least a portion of the buffer tube 26 therein. The buffer tube passage 30 includes an axially-extending keyway 34 along a lower side thereof to accommodate a key 36 on the underside of the buffer tube 26. The stock body 20 is preferably integrally molded from a strong and substantially rigid plastic material.

The stock body 20 additionally defines an adjustment slit 40 extending axially rearwards from the buffer tube insertion opening 32. The adjustment slit 40 communicates with a forward portion of the buffer tube passage 30 and extends radially outward therefrom. Compression of the adjustment slit 40 by the second adjustment mechanism 24 allows the buffer tube passage 30 proximate the buffer tube insertion opening 32 to clamp securely around the buffer tube 26. The capacity of the stock body 20 for flexion in this area is enhanced by a transverse slit 42 defined extending through the stock body rearward of the adjustment slit 40 and extending radially downward from the buffer tube passage 30.

The stock body 20 advantageously includes a buffer tube accommodation portion 44, in which the buffer tube passage 30 is defined, and an angled lower portion 46 extending rearwardly and downwardly from a forward end of the buffer tube accommodation portion 44. A central opening 48 is defined between the portions 44, 46. A butt portion 50 extends generally vertically between rearward ends of the buffer tube accommodation portion 44 and angled lower portions 46 and such portions surrounds and defines the central opening 48.

A sling loop 52 is formed on an upper surface of the buffer tube accommodation portion 44, defining a passage for a sling or other carrying device for the firearm. A plurality of finger grooves 54 are defined along a lower surface of the angled lower portion 46 to facilitate grasping by a user. A removable butt plate 56 snaps onto a rear surface of the butt portion 50 and is further secured thereto by a pair of spaced fasteners 60, such as screws. A bushing opening 62 is defined in an elbow between the angled lower portion 46 and the butt portion 50, and removably accommodates a bushing 64 through which a sling clip or other accessory can be pivotably routed.

Other features are defined in the stock body 20 that will be described in connection with associated components of the first and second adjustment mechanisms 22, 24.

Referring to FIGS. 1-15, the first adjustment mechanism 22 includes a buffer tube engagement element 70, a first operating lever 72, and a biasing mechanism 74, such as a compression spring. The biasing mechanism 74 urges the buffer tube engagement element 70 at least partially into the buffer tube passage 30 and into engagement with the buffer tube 26, and the first operating lever 72 is operable to move the engagement element 70 downwards and out of engagement with the buffer tube 26. By selectively engaging detents 76 in the key 36 of the buffer tube 26, the first operating mechanism 22 is operable to releasably secure the collapsible stock assembly 10 at a plurality of discrete points along the buffer tube 26.

Figure 14:
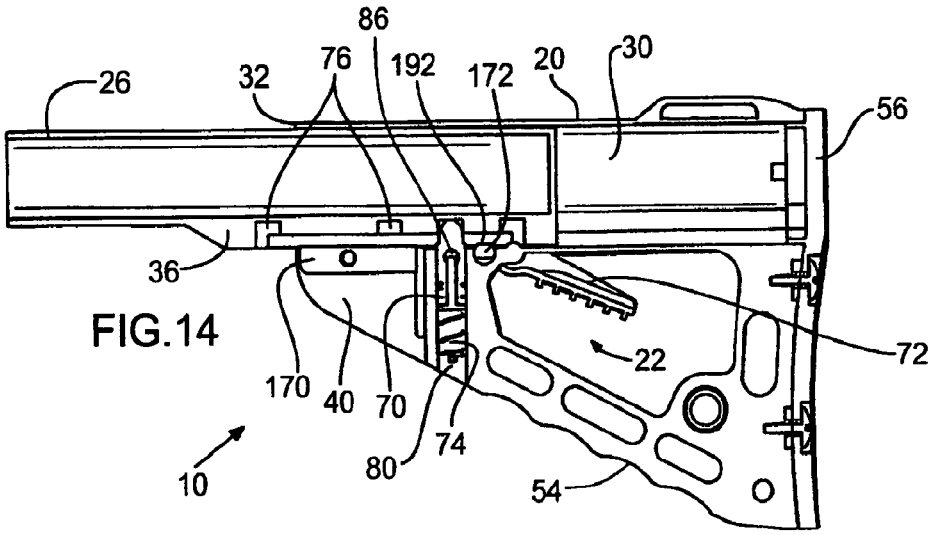
FIG. 14 is a sectional view taken along line 14-14 of FIG. 13.

Referring more particularly to FIGS. 1, 2 and 14, the buffer tube engagement element 70 and biasing mechanism 74 are accommodated in an engagement element channel 80 defined in the stock body 20 intersecting the buffer tube passage 30. Also defined in the stock body 20 below the buffer tube passage 30 are an operator slot 82 and a retention pin hole 84.

The buffer tube engagement element 70 is retained within the engagement element channel 80 by an operator pin 86 inserted through the operator slot 82 and an operator bore 90 in the engagement element 70. The biasing mechanism 74 is retained in the channel 80 below the buffer tube engagement element 70 by a retention pin 92 inserted through the retention pin hole 84. The biasing mechanism 74 acts on the buffer tube engagement element 70 via a piston 94 inserted into a central bore 96 (see FIG. 4) defined in the engagement element 70. An upper end of the piston 94 engages a slot 100 in the center of the operator pin 86, retaining the operator pin 86 in place.

Figure 3:
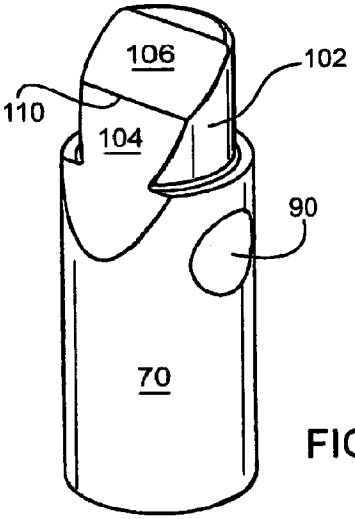
FIG. 3 is a top perspective view of a first embodiment of a buffer tube engagement element of the first adjustment mechanism of FIG. 2.
Figure 4:
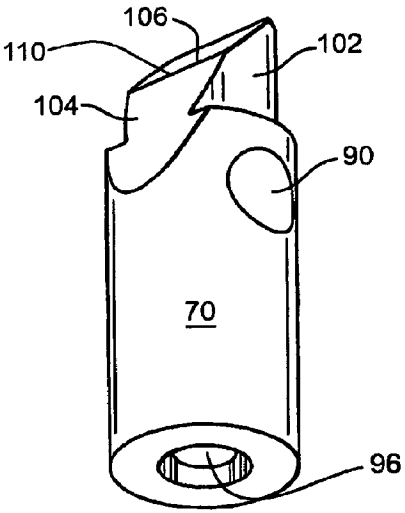
FIG. 4 is a bottom perspective view of the element of FIG. 3.

Referring more particularly to FIGS. 3 and 4, the buffer tube engagement element 70 is generally cylindrical with a reduced-diameter upper portion 102. On a side facing the buffer tube insertion opening 32, the engagement element 70 preferably includes first and second engagement faces 104, 106. With the buffer tube engagement element 70 displaced fully upwards, the engagement faces 104, 106 protrude into the buffer tube passage 30. The first engagement face 104 is angled rearwardly away from the insertion opening 32. The second engagement face 106 shares a common edge 110 with the first engagement face 104, and from that edge 110 is angled rearwardly away from the insertion opening 32 at a steeper angle than the first engagement face 104.

With the buffer tube engagement element 70 fully extended into one of the detents 76 of the buffer tube 26, the first engagement face 104 is initially encountered in response to forces tending to drive the stock assembly 10 forward on the buffer tube 26. The more vertical arrangement of the first face 104 provides greater resistance to such forward movement, and the angle should be set so as to prevent such movement in response to forces encountered during routine operation of a the firearm to which the buffer tube 26 is attached. For example, recoil forces should not be sufficient to overcome the engagement between any of the detents 76 with the first engagement face 104.

However, greater forces, such as incurred when inadvertently dropping the firearm on the butt plate 56 from a height of several feet or using the rifle and butt stock as a battering ram, will be great enough to drive the buffer tube engagement element 70 downwards such that the second engagement face 106 is encountered by the corresponding detent 76. The steeper angle of the second engagement face 106 results in a lower resistance to further downward movement of the buffer tube engagement element 70, thus forward motion of the collapsible stock assembly 10 will continue at an accelerated pace, overcoming engagement with any additional detents 76, until the external force is no longer applied or the stock assembly 10 reaches the physical limit of its most forward motion on the buffer tube. Thus, the collapsible stock assembly 10 can provide a self-releasing function and For act as a shock absorber to prevent damage to the buffer tube engagement element 70 if the firearm is dropped or otherwise has excessive forces applied to the butt stock or is mishandled. Also, damage to the buffer tube 26, and particularly to the detents 76, and stock assembly 10 is minimized with the use of element 70.

Figure 5:
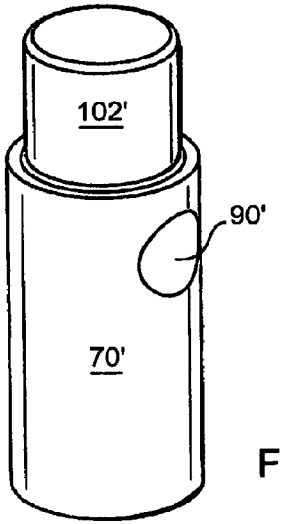
FIG. 5 is a top perspective view of a second embodiment of a buffer tube engagement element of the first adjustment mechanism of FIG. 2.
Figure 6:
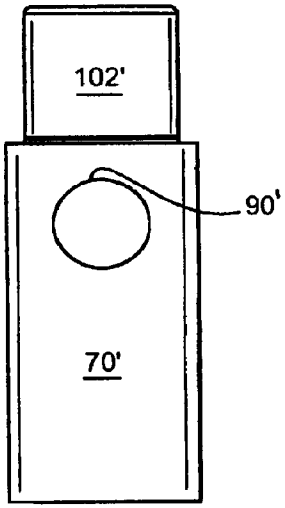
FIG. 6 is a side elevational view of FIG. 5.

Referring to FIGS. 5 and 6, in a second embodiment of the buffer tube engagement element 70', there are no angled engagement faces and the reduced diameter upper portion 102' is simply cylindrical and may permit damage to the butt stock and/or buffer tube 26 due to the fact that the aforementioned self-releasing is not provided by element 70'.

Figure 7:
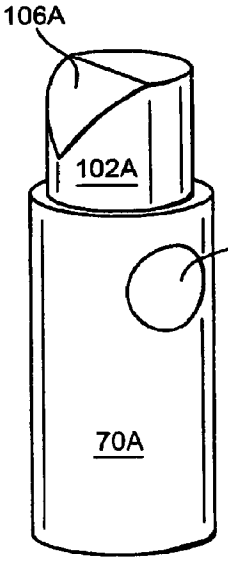
FIG. 7 is a top perspective view of a third embodiment of a buffer tube engagement element of the first adjustment mechanism of FIG. 2.
Figure 8:
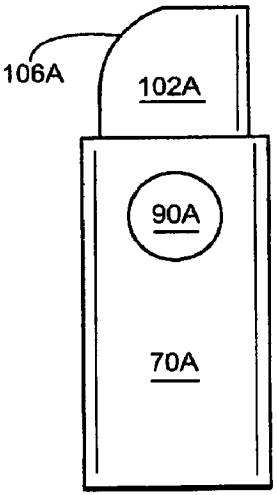
FIG. 8 is a side elevational view FIG. 7.

Referring to FIGS. 7 and 8, a third embodiment of the buffer tube engagement element 70A is shown having a rounded engagement face 106A on a side facing the buffer tube insertion opening 32 extending only on the reduced-diameter upper portion 102A. Use of element 70A, rather than element 70, would result in a similar release of the stock assembly 10 from any of the detents 76 rearwardly of the most forward detent 76 of buffer tube 26 so that element 70A would engage in such most forward detent 76, which may cause some damage to the stock assembly 10 and/or buffer tube 26.

Figure 9:
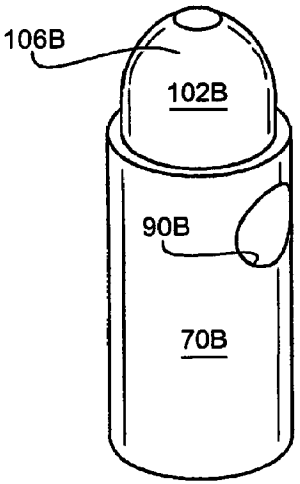
FIG. 9 is a top perspective view of a fourth embodiment of a buffer tube engagement element of the first adjustment mechanism of FIG. 2.
Figure 10:
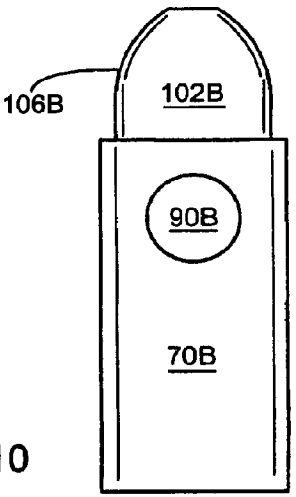
FIG. 10 is a side elevational view of FIG. 9.

Referring to FIGS. 9 and 10, a fourth embodiment of the buffer tube engagement element 70B is shown having a bulbous or bullet-shaped upper portion 102B, where the engagement surface 106B is located similarly to FIGS. 7 and 8, and extend only on the reduced diameter upper portion 102B. Use of element 70B has an advantage of being less costly to manufacture than element 70 or even element 70A, while providing similar results to that set forth above with reference to FIGS. 7 and 8.

Figure 11:
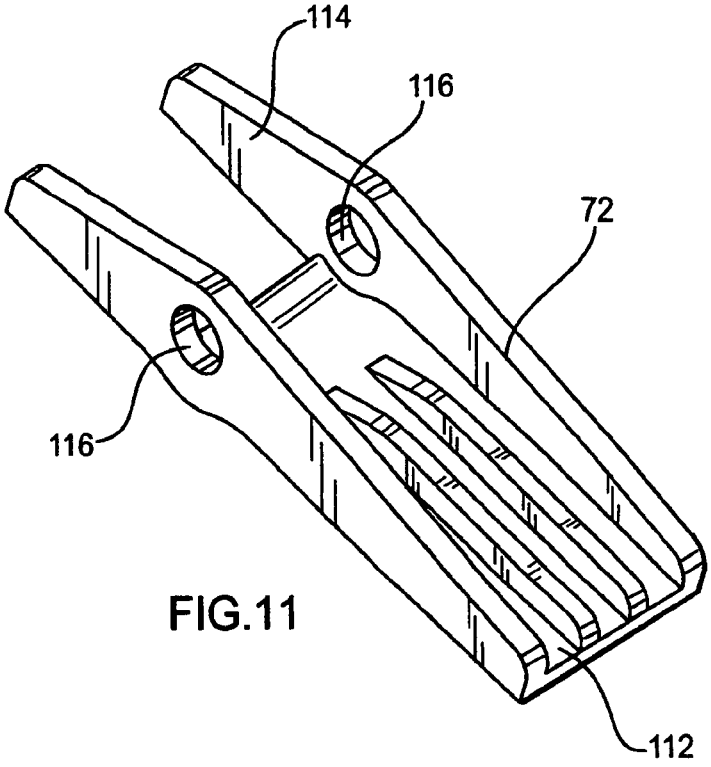
FIG. 11 is a perspective view of a first operating lever of the first adjustment mechanism of FIG. 1.
Figure 12:
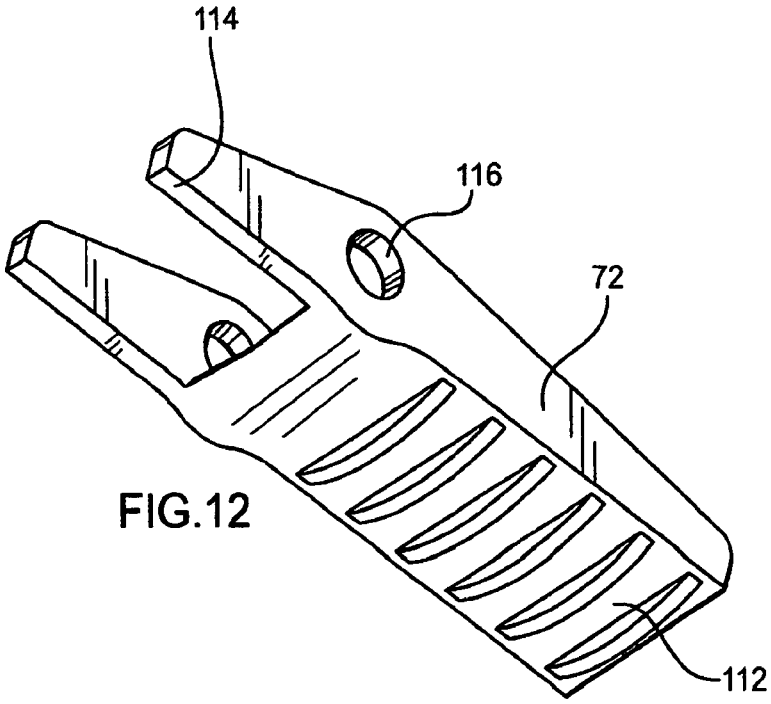
FIG. 12 is another perspective view of the first operating lever of FIG. 11.

Referring to FIGS. 11 and 12, the first operating lever 72 extends between first and second ends 112, 114, being pivotably mounted therebetween to the stock body 20. Mounting holes 116 are defined in opposite sides of the first operating lever 72 that snap over mounting protrusions 120 (see FIG. 1) on opposite sides of the stock body 20. The first end 112 extends into the central opening 48 defined by the buffer tube accommodation, angled lower and butt portions 44, 46, 50 of the stock body 20 and is operable by a user extending his fingers therethrough and urging the first end 112 upwards. To facilitate operation, the first end 112 can be textured. The second end 114 is forked to extend on opposite sides of the stock body 20, facilitating ambidextrous operation of the collapsible stock assembly 10, as will be explained in greater detail below.

Figure 13:
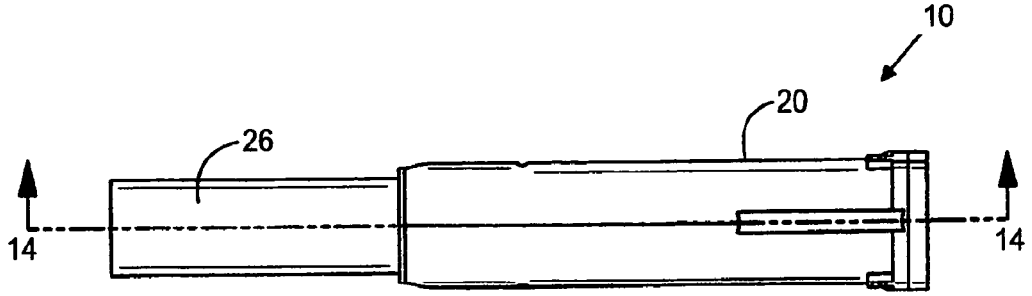
FIG. 13 is a top view of the stock assembly of FIG. 1 in a first state relative to the buffer tube.
Figure 15:
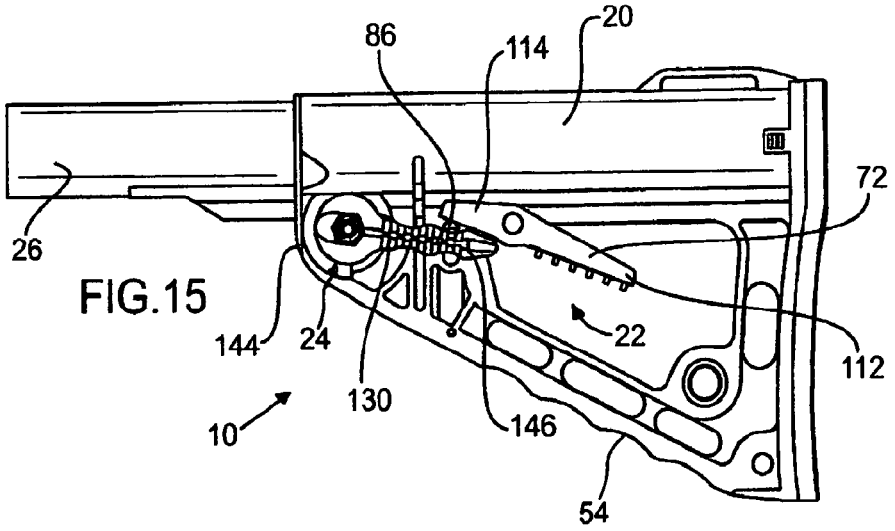
FIG. 15 is a side view of the stock assembly and buffer tube of FIG. 13.

In FIGS. 13-15 the first adjustment mechanism 22 is in the engaged position, with the buffer tube engagement element 70 fully engaged within a detent 76 of the buffer tube 26. Except as described above in connection with the dropped firearm scenario, the collapsible stock assembly 10 is inhibited from forward and rearward motion by this engagement.

Figure 16:
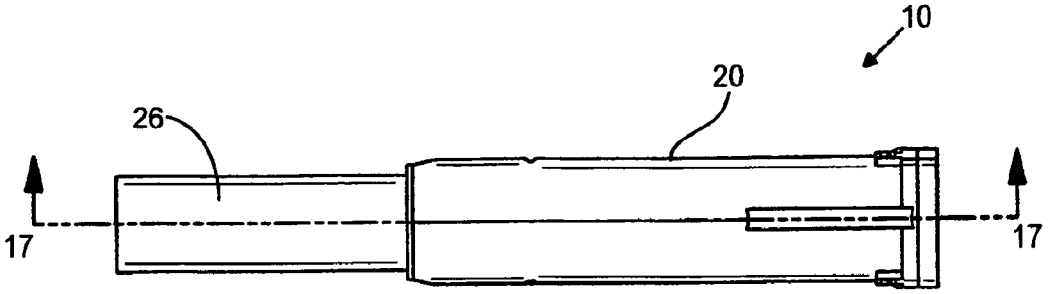
FIG. 16 is a top view of the stock assembly of FIG. 16 in a second state relative to the buffer tube.
Figure 17:
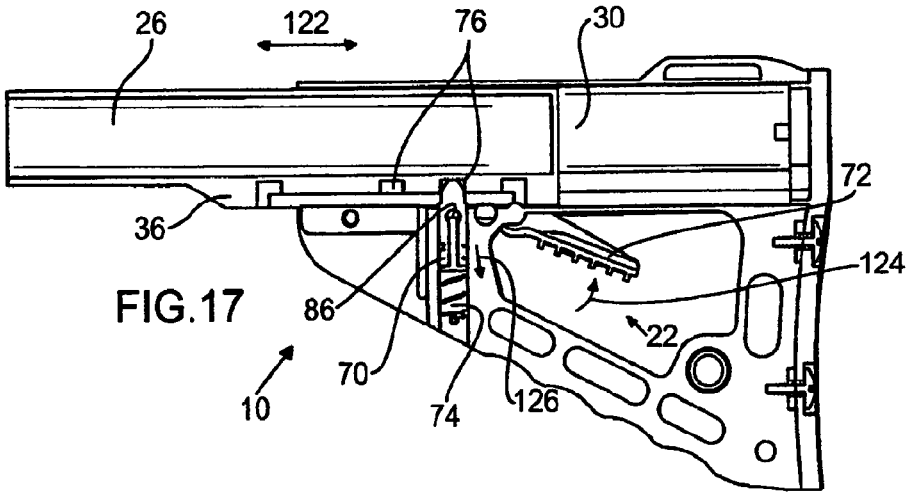
FIG. 17 is a sectional view taken along line 17-17 of FIG. 16.
Figure 18:
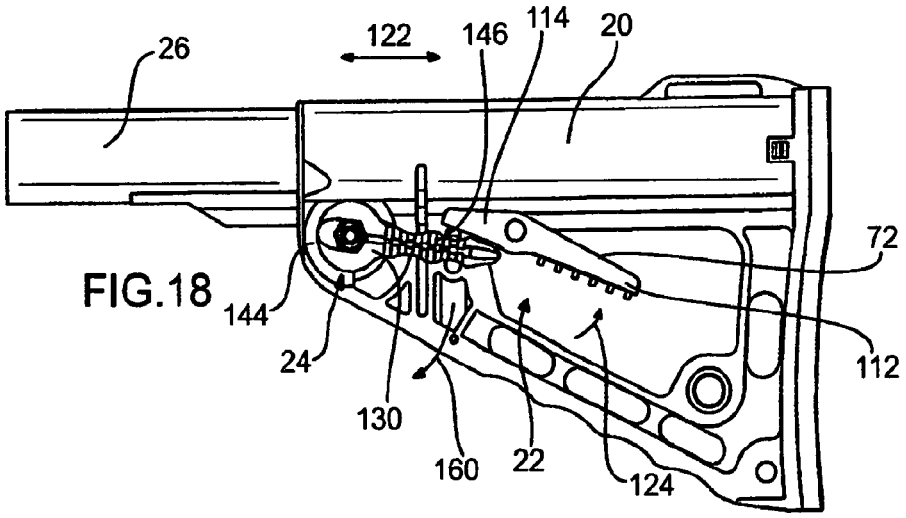
FIG. 18 is a side view of the stock assembly and buffer tube of FIG. 16.
Figure 19:
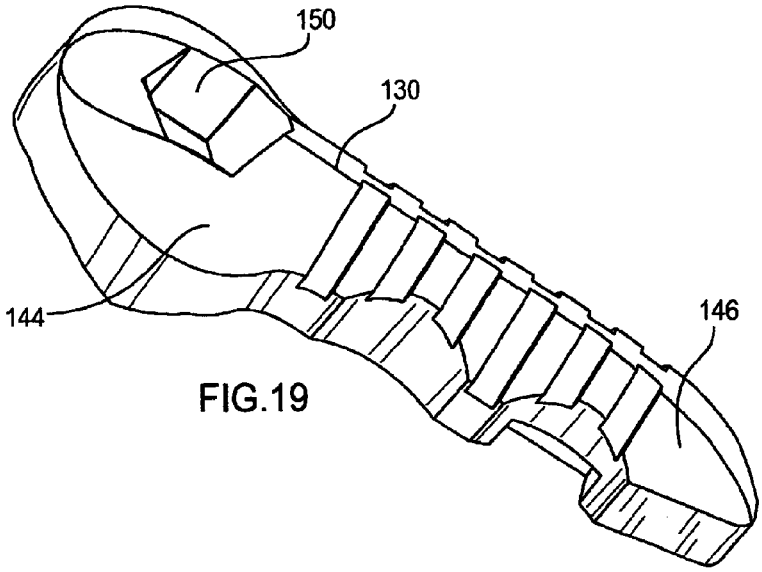
FIG. 19 is a perspective view of a second operating lever of the second adjustment mechanism of FIG. 1.
Figure 20:
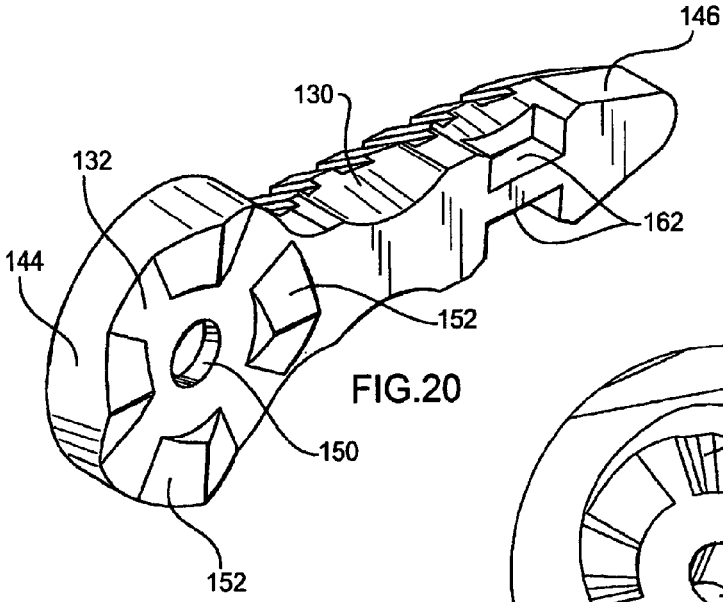
FIG. 20 is another perspective view of the second operating lever of FIG. 17.
Figure 21:
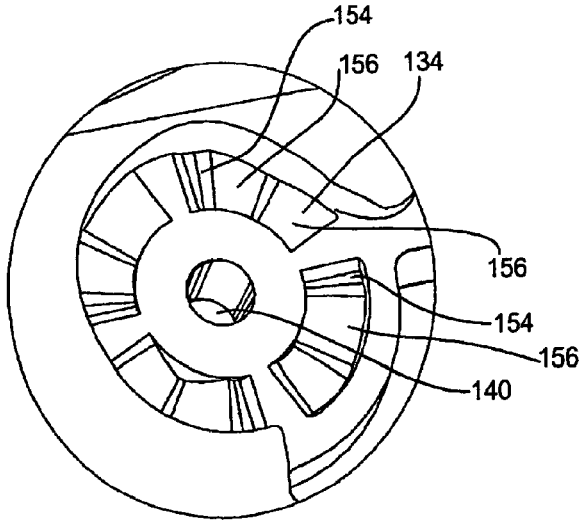
FIG. 21 is a detailed perspective view of area 16 of FIG. 2.

Referring to FIGS. 16-18, to allow forward or rearward motion, in the direction of arrow 122, the first operating lever 72 first end 112 is pivoted toward the stock body 20 in the direction of arrow 124. Consequently, the first operating lever 72 second end 114 moves downwardly in the direction of arrow 126. The second end 114 engages the ends of the operator pin 86, urging the buffer tube engagement element 70 downwardly against the biasing mechanism 74. Once the engagement element 70 is completely clear of the detent 76, the stock body 20 can be moved forwardly or rearwardly in the direction of arrow 122. To allow the engagement element 70 to engage another detent, the first operating lever 72 first end 112 is released and the biasing mechanism 74 urges the engagement element 70 upwardly.

Referring to FIGS. 2 and 19-21, the second adjustment mechanism 24 includes a second operating lever 130 having a stock body engagement portion 132 that variably engages an underlying engagement surface 134 on the stock body 20. The second operating lever 130 is pivotably mounted to the stock body 20 by one or fasteners 136, for instance a machine screw and lock nut, inserted through a second operating lever mounting bore 140 defined in the stock body 20. Advantageously, engagement surfaces 134 are formed on both sides of the stock body 20 to allow the second operating lever 130 to be mounted on either side thereof. The unused engagement surface can be covered by a blank 142.

The second operating lever 130 has a first end 144 and a second end 146. The first end 144 carries the stock body engagement portion 132 and defines a central mounting bore 150 for receiving the fasteners 136. Advantageously, a portion of the mounting bore 150 can be hexagonal to closely accommodate a nut therein. The second end 146 extends rearwardly from the first end 144 and can be contoured and textured for easy manipulation by a user.

The stock body engagement portion 132 carries a plurality of engagement teeth 152 that extend from the second operating lever 130 first end 144 toward the stock body 20. The engagement surface 134 includes a plurality of adjacent high and low zones 154, 156 underlying the engagement teeth 152. With the second operating lever 130 pivoted via manipulation of the second end 146 such that the teeth 152 overlie high zones 156, the adjustment slit 40 of the stock body 20 is compressed (as in FIG. 15). Consequently, the end of the buffer tube passage 30 proximate the buffer tube insertion opening 32 tightly engages the buffer tube 26, inhibiting slop or play between the collapsible stock assembly 10 and the buffer tube 26 during use of the associated firearm.

To release the second adjustment mechanism 24, the second end 146 is urged downwardly, in the direction of arrow 160 (as in FIG. 18). This pivots the engagement teeth 152 over the low zones 156, allowing the adjustment slit 40 to open and disengage the end of the buffer tube passage 30 proximate the buffer tube insertion opening 32 from the buffer tube 26. Advantageously, the second adjustment mechanism 24 is automatically disengaged when the first adjustment mechanism 22 is disengaged, since one of the bifurcated second ends 114 proximate lever 130 moves downwardly and causes mechanism 24 to disengage.

As seen in FIGS. 15 and 18, the first operating lever 72 second end 114 is in close proximity to the second operating lever 130 second end 146, so that manual pivoting the first operating lever 72 to disengage the buffer tube engagement element 70 will result in pivoting of the second operating lever 130 to open the adjustment slit 40. In the depicted embodiment, the first operating lever 72 second end 114 acts on the second operating lever 130 second end 146 via the operator pin 86.

Because the operator pin 86 and the first operating lever 72 second end 114 extend on both sides of the stock body 20, automatic disengagement of the second adjustment mechanism 24 will occur regardless of the side on which the second operating lever 130 is mounted. The second operating lever 130 second end 146 can also include operator pin grooves 162 (see FIG. 20) to facilitate engagement of the operator pin 86 when mounted on either side.

From the foregoing, it will be appreciated that a collapsible stock assembly according to the present invention allows quick re-positioning of the stock body according to the needs or preferences of a user without sacrificing the solid feel. Additionally, the addition of the second adjustment mechanism 24 is accomplished without requiring any additional user actions to disengage. Moreover, the useful life of the collapsible stock assembly is increased, as increased play resulting from wear in adjustment mechanisms can be avoided by simply tightening the fasteners 136 to adjust the tension exerted by the second adjustment mechanism 24. Also, if wear does occur, the second adjustment mechanism 24 may be able to compensate for such wear thereby extending the useable life of the butt stock and/or the rifle buffer tube 26.

For some firearm models, buffer tubes are available in multiple sizes. For example, for AR/M4 stocks the buffer tubes come in a Mil-Spec size and a slightly larger Commercial size. For many collapsible stocks, this means either a different stock must be used for different buffer tube sizes, or additional looseness is experienced when using the stock on a Mil-Spec buffer tube.

The collapsible stock assembly 10 can advantageously include sizing components to ensure a close fit for multiple sizes. Referring to FIG. 2, the sizing components include a sizing shim 170 and a sizing pin 172. The sizing shim 170 is releasable secured in the adjustment slit 40 and the sizing pin 172 is releasably secured in a sizing passage 174 defined in the stock body 20 generally perpendicular to and partially intersecting the buffer tube passage 30.

Figure 22:
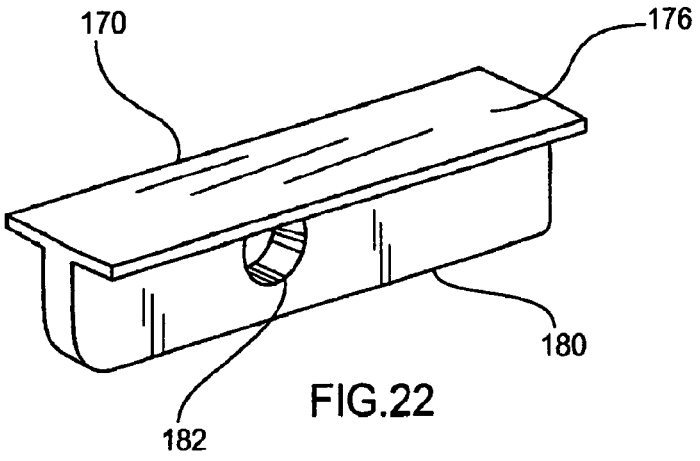
FIG. 22 is a perspective view of one of the sizing components of FIG. 1.

Referring to FIGS. 2 and 22, the sizing shim 170 includes a shim surface 176 with a retention portion 180 depending downwardly therefrom. The shim surface 176 rests in the keyway 34 and elevates the key 36 of the buffer tube 26 when the shim 170 is installed. The retention portion 180 extends into the adjustment slit 40 and has retention bore 182 defined therein so that the shim 170 is releasable secured in place by the fastener 136 of the second adjustment mechanism 24.

Figure 23:
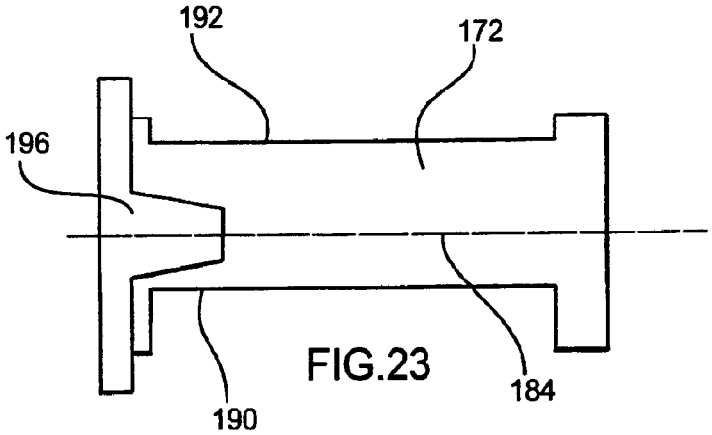
FIG. 23 is a side view of another one of the sizing components of FIG. 1.
Figure 24:
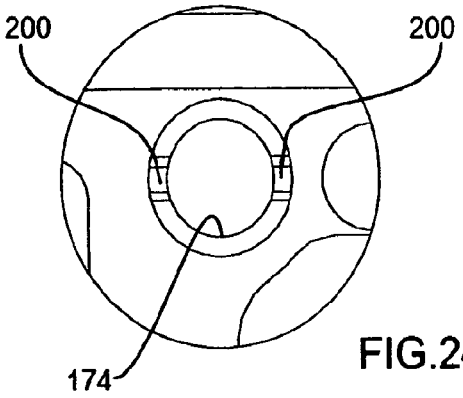
FIG. 24 is detailed side view of area 19 of FIG. 2.

Referring to FIGS. 23 and 24, the sizing pin 172 extends along a sizing pin axis 184 and has first and second sizing faces 190, 192. The second sizing face 192 is farther from the sizing pin axis 184 than the first sizing face 190. When the sizing pin 172 is inserted into the sizing passage 174 with the second sizing face 192 oriented upwardly, the second sizing face 192 protrudes into the keyway 34 (see FIG. 14) and cooperates with the sizing shim 170 to elevate the key 36 of the buffer tube 26. Correct orientation of the sizing pin 172 is ensured by complementary protrusions 196 and recesses 200 on the pin 172 and sizing passage 174. Inadvertent removal of the sizing pin 172 is prevented by interference from the first operating lever 72 second end 114.

If the collapsible stock assembly 10 is to be used with a large buffer tube, the sizing shim 170 is removed and the sizing pin 172 is removed and reinstalled with the first sizing face 190 oriented upwardly. The key of the larger buffer tube can extend all the way to the bottom of the keyway 34. As will be appreciated, the sizing components thereby allow the collapsible stock assembly 10 to accommodate buffer tubes of multiple sizes without sacrificing a firm, reliable fit.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A collapsible stock assembly for a firearm, the assembly comprising:

a stock body having a buffer tube passage defined therein extending in an axial direction, a buffer tube insertion opening being defined on a forward end of the stock body to allow insertion of a rear end of a firearm buffer tube therein in the axial direction, the buffer tube passage being dimensioned to slidably accommodate at least a portion of the buffer tube therein, the stock body also defining an adjustment slit extending axially rearwards from the buffer tube insertion opening and communicating with a forward portion of buffer tube passage and extending radially outward therefrom;

a first adjustment mechanism carried by the stock body, and including a buffer tube engagement element displaceable into the buffer tube passage and a first operating lever operable to selectively position the buffer tube engagement element; and a second adjustment mechanism carried by the stock body, and including a second operating lever having a stock body engagement portion, the second operating lever operable to selectively engage the stock body with the stock body engagement portion to compress the adjustment slit.

2. The assembly of claim 1, wherein the first adjustment mechanism further includes an engagement element biasing mechanism, the biasing mechanism biasing the buffer tube engagement element into the buffer tube passage, and the first operating lever being operable to urge the buffer tube engagement element out of the buffer tube passage.

3. The assembly of claim 2, wherein the engagement element is a compression spring.

4. The assembly of claim 2, wherein the stock body further defines an engagement element channel extending radially outward from the buffer tube passage, the engagement element biasing mechanism and the engagement element being arranged in the engagement element channel.

5. The assembly of claim 2, wherein the first operating lever is pivotably mounted to the stock body between first operating lever first and second ends thereof, such that the first operating lever first end urges the engagement element out of the buffer tube passage when the first operating lever second end is urged toward the buffer tube passage.

6. The assembly of claim 5, wherein the first and second operating lever are arranged on the stock body in proximity such that urging the first operating lever second end toward the buffer tube passage is operable to disengage the second operating lever from compressing the adjustment slit.

7. The assembly of claim 1, wherein the first and second operating lever are arranged on the stock body in proximity such that the first operating lever is further operable to disengage the second operating lever from compressing the adjustment slit and the second operating lever being located forwardly of the first operating lever.

8. The assembly of claim 1, wherein the stock body engagement portion of the second operating lever includes at least one engagement tooth extending toward the stock body.

9. The assembly of claim 8, wherein at least one contoured engagement surface is defined on the stock body underlying the at least one engagement tooth, such that moving the at least one engagement tooth over the at least one contoured engagement surface will adjust compression of the adjustment slit.

10. The assembly of claim 9, wherein the at least one contoured engagement surface includes at least one locking detent proximate an end thereof to releasably hold the at least one engagement tooth with the adjustment slit compressed.

11. The assembly of claim 1, wherein the stock body includes a buffer tube accommodation portion in which the buffer tube passage is defined, an angled lower portion extending rearwardly and downwardly from a forward end of the buffer tube accommodation portion and a butt portion extending between rearward ends of the buffer tube accommodation portion and the angled lower portion, an operating lever opening being defined between the buffer tube accommodation portion and the angled lower portion and the butt portion, the first operating lever extending into the operating lever opening.

12. The assembly of claim 1, wherein the buffer tube engagement element includes first and second engagement faces displaceable into the buffer tube passage, the first engagement face being angled rearwardly away from the buffer tube insertion opening, the second engagement face being angled rearwardly away from the buffer tube insertion opening at a steeper angle than the first engagement face, the first and second engagement faces sharing a common edge with the second engagement face displaceable further into the buffer tube passage than the first engagement face.

13. The assembly of claim 12, wherein the second engagement face extends below a most forward detent of a plurality of spaced detents extending along the buffer tube wherein excessive forward force on the rear of the stock assembly unlocks the engagement element from a detent engaged therewith and all the detents of the buffer tube and the stock assembly moves to its most forward position on the buffer tube.

14. The assembly of claim 2, wherein the buffer tube engagement element includes a forward engagement face displaceable into the buffer tube passage, the forward engagement face extends below a most forward detent of a plurality of spaced detents extending along the buffer tube, wherein excessive forward force on the rear of the stock assembly unlocks the engagement element from a detent engaged therewith and all the detents of the buffer tube and the stock assembly moves to its most forward position on the buffer tube.

15. The assembly of claim 2, wherein the buffer tube engagement element includes a reduced upper portion displaceable into the buffer tube passage and a larger lower portion, the upper portion having a forward curved engagement face extending rearwardly and engageable with a selected detent of a plurality of spaced detents extending along the buffer tube, excessive forward force on the rear of the stock assembly causes the engagement element to move out of the buffer tube passage and unlocks the engagement element from the selected detent and from all detents except the most forward detent and the stock assembly moves forwardly until the larger lower portion engages in the most forward detent.

16. The assembly of claim 1, further comprising a sizing shim releasably accommodated in the adjustment slit.

17. The assembly of claim 1, further comprising a sizing pin extending along a sizing pin axis, the sizing pin having first and second sizing face, the second sizing face being farther from the sizing pin axis than the first sizing face; and wherein the stock body further defines a sizing passage partially intersecting and extending generally perpendicular to the axial direction of the buffer tube passage, the sizing pin being releasably arranged in the sizing passage with one of the first and second faces extending into the buffer tube passage.

18. A collapsible stock assembly for a firearm, the assembly comprising;

a stock body defining a buffer tube passage extending in an axial direction therein, and a buffer tube insertion opening on a forward end of the stock body to allow insertion of a rear end of a firearm buffer tube therein in the axial direction, the buffer tube passage being dimensioned to slidably accommodate at least a portion of the buffer tube therein, an engagement element channel extending radially outward from the buffer tube passage, at least one contoured engagement surface, and an adjustment slit extending axially rearwards from the buffer tube insertion opening, communicating with a forward portion of buffer tube passage and extending radially outward therefrom, and a first adjustment mechanism including;

a buffer tube engagement element slidably arranged in the engagement element channel, an engagement element biasing mechanism arranged in the engagement element channel and biasing the buffer tube engagement into the buffer tube passage, and a first operating lever mounted to the stock body and operable to urge the buffer tube engagement element out of the buffer tube passage; and a second adjustment mechanism including;

at least one engagement tooth slidably overlying the at least one contoured engagement surface, and a second operating lever mounted to the stock body and carrying the at least one engagement tooth, the second operating lever being operable to move the at least one engagement tooth over the at least one contoured engagement surface to adjust compression of the adjustment slit.

19. The assembly of claim 18, wherein the stock body includes a buffer tube accommodation portion in which the buffer tube passage is defined, an angled lower portion extending rearwardly and downwardly from a forward end of the buffer tube accommodation portion and a butt portion extending between rearward ends of the buffer tube accommodation portion and the angled lower portion, an operating lever opening being defined between the buffer tube accommodation portion, the angled lower portion and the butt portion, the first operating lever extending into the operating lever opening.

20. The assembly of claim 18, wherein the first and second operating levers are pivotably mounted in proximity such that, with the second adjustment mechanism compressing the adjustment slit, operating the first operating lever to urge the buffer tube engagement element out of the buffer tube passage will automatically operate the second operating lever from compressing the adjustment slit the second operating lever being located forwardly of the first operating lever.

* * * * *